US008657163B2

(12) United States Patent
Eriksson

(10) Patent No.: US 8,657,163 B2
(45) Date of Patent: Feb. 25, 2014

(54) DRAINING DEVICE WITH A PUNCTURING DEVICE FOR PUNCTURING A PACKAGE CONTAINING LIQUID MATERIAL

(76) Inventor: Vilho Eriksson, Stockholm (SE)

( * ) Notice: Subject to any disclaimer, the term of this patent is extended or adjusted under 35 U.S.C. 154(b) by 63 days.

(21) Appl. No.: 13/128,912

(22) PCT Filed: Nov. 24, 2009

(86) PCT No.: PCT/SE2009/051325

§ 371 (c)(1),
(2), (4) Date: May 12, 2011

(87) PCT Pub. No.: WO2010/062247

PCT Pub. Date: Jun. 3, 2010

(65) Prior Publication Data

US 2011/0215106 A1 Sep. 8, 2011

(30) Foreign Application Priority Data

Nov. 27, 2008 (SE) ..... 0802491

(51) Int. Cl.
*B67D 1/00* (2006.01)
*B67D 3/00* (2006.01)

(52) U.S. Cl.
USPC ..... 222/536; 222/83; 222/105; 222/185.1; 222/534

(58) Field of Classification Search
USPC ..... 222/80, 81, 83, 89, 92, 105, 185.1, 526, 222/533–536, 538, 541.1
See application file for complete search history.

(56) References Cited

U.S. PATENT DOCUMENTS

| | | | | | |
|---|---|---|---|---|---|
| 283,287 | A | * | 8/1883 | Schoening | 222/465.1 |
| 470,838 | A | * | 3/1892 | Hart | 222/534 |
| 473,325 | A | * | 4/1892 | Merrill | 222/512 |
| 515,552 | A | * | 2/1894 | Phelps | 222/534 |
| 519,534 | A | * | 5/1894 | James | 222/534 |
| 521,113 | A | * | 6/1894 | Hart | 222/536 |
| 523,627 | A | * | 7/1894 | Ebling | 222/481 |
| 1,259,057 | A | * | 3/1918 | Vick | 222/83 |
| 1,290,814 | A | * | 1/1919 | Weaver | 73/306 |
| 1,417,951 | A | * | 5/1922 | Staples et al. | 222/534 |
| 2,021,411 | A | * | 11/1935 | Garrison | 222/402.16 |

(Continued)

FOREIGN PATENT DOCUMENTS

| | | |
|---|---|---|
| GB | 2 068 910 A | 8/1981 |
| SE | 525007 | 11/2004 |
| WO | WO 98/33714 A1 | 8/1998 |
| WO | WO 01/54991 A1 | 8/2001 |

*Primary Examiner* — Kevin P Shaver
*Assistant Examiner* — Patrick M Beuchner
(74) *Attorney, Agent, or Firm* — Dickstein Shapiro LLP

(57) ABSTRACT

A draining device and a package with such a draining device for a liquid material. The draining device comprises a housing part and a draining part, which is articulated around an axis in relation to the housing part. The housing part comprises a first channel with an inlet which ends on the inside of the package. The draining part comprises a second channel with an outlet which ends on the out-side of the package. The housing part is arranged to be attached on the outside of the wall of the package. The draining part is arranged with at least one puncturing device in its end being arranged opposite to the outlet. The puncturing device is arranged to puncture the wall of the package so that at least one passage is formed through which liquid material being located in the package may be made to flow out through the draining part to the outside of the package.

12 Claims, 7 Drawing Sheets

(56) References Cited

U.S. PATENT DOCUMENTS

| | | | | | |
|---|---|---|---|---|---|
| 2,571,798 | A | * | 10/1951 | Urch | 222/83.5 |
| 2,617,559 | A | * | 11/1952 | Van Der Spek | 222/83 |
| 3,329,316 | A | * | 7/1967 | Lowe | 222/183 |
| 3,653,546 | A | * | 4/1972 | Hazard | 222/83 |
| 4,081,108 | A | * | 3/1978 | Wilson et al. | 222/153.06 |
| 4,314,654 | A | * | 2/1982 | Gaubert | 222/83 |
| 4,322,018 | A | * | 3/1982 | Rutter | 222/83 |
| 4,355,737 | A | * | 10/1982 | Pongrass et al. | 222/81 |
| 4,416,395 | A | | 11/1983 | Gaubert | |
| 4,475,670 | A | * | 10/1984 | Rutter | 222/83 |
| 4,919,306 | A | * | 4/1990 | Heaps et al. | 222/105 |
| 5,000,359 | A | * | 3/1991 | Scholle et al. | 222/505 |
| 2009/0084814 | A1 | * | 4/2009 | Wisniewski et al. | 222/83 |
| 2012/0181303 | A1 | * | 7/2012 | Swanick | 222/83 |

* cited by examiner

DRAINING DEVICE WITH A PUNCTURING DEVICE FOR PUNCTURING A PACKAGE CONTAINING LIQUID MATERIAL

TECHNICAL FIELD

The invention relates to a drainage device for a package for a fluid material.

BACKGROUND

For standing liquid filled bag type packages with a relatively large volume, for example more than 1.5 liters, a draining valve arranged on a side surface of the package, for emptying contents from the package, is often used, as packages according to the above formed by a thin plastic foil material often may be difficult to empty from an opening arranged on the upper surface of the package without spillage, as the package is experienced as being yieldable when one tries to tip it over to pour out its contents.

Draining valves are for example used in packages of the "bag-in-box" type where a flexible liquid filled bag provided with a draining valve arranged through the wall of the bag is arranged within a rigid package. The draining valve is inserted in the rigid package during transport, but is arranged to be possible to pull out from the rigid package when one desires to drain liquid from the bag.

SE 525 077 C2 shows a bag of a flexible sheet material with two side walls, where an elastic material string defining a stabilizing transition between the vertical side wall and the horizontal bottom of a filled bag, is connected to each one of the side walls in its lower edge.

SHORT DESCRIPTION OF THE INVENTION

The problem with emptying a package is solved according to the invention by a draining device and a package.

A draining device according to the invention is intended for a package for a liquid material. The draining device comprises a housing part and a draining part which is arranged movable in relation the housing part, wherein the draining part is attached articulated to the housing part around an axis in a joint, wherein the housing part comprises a first channel with an inlet which ends towards the inside of the package during draining of the contents and an outlet which ends in the section surface between the housing part and the draining part, and wherein the draining part comprises a second channel with an inlet which ends in the section surface between the housing part and the draining part and an outlet which ends on the outside of the package. The draining device is characterized in that the housing part of the draining device is arranged to be attached on the outside of the wall of the package, essentially vertical in the normal draining position of the package and that the draining part is arranged with at least one puncturing device in its end being opposite to the outlet, which puncturing device is arranged to puncture the wall of the package so that at least one passage is formed in the wall of the package through which passage liquid material located in the package may be made to flow out through the draining part to the outside of the package whereby the package may be emptied via the draining device, wherein the outlet of the channel in the housing part is arranged to change from not being in contact with to partially abut the inlet of the channel in the draining part in a position where the channel in the draining part inclines at least somewhat downwards in the direction towards its outlet seen in relation to the horizontal plane.

With liquid material is primarily meant a liquid. The liquid may have an arbitrary viscosity. With the term liquid material also an emulsion and a paste in which solid particle may be mixed with a liquid, are referred to.

The outlet of the channel in the house part is made to change from not being in contact with to partly abut the inlet of the channel in the draining part through rotation of the draining part in relation to the house part.

Partly abutment of the outlet of the channel in the house part against the inlet of the channel in the draining part occurs firstly in a position where the channel in the draining part inclines at least somewhat downwards in the direction toward its outlet seen relative to the horizontal plane.

Primarily, a draining device according to the invention is intended to be used on liquid filled packages of bag type with a relatively large volume and which are intended to be emptied standing. Packages of this type are mentioned in the introduction of the description of the prior art. Such packages stand still on a surface during emptying of the package.

By placing the draining device on a wall which is essentially vertical favourable characteristics for emptying of the container are achieved.

The draining device may be arranged so that the axis is essentially horizontal and that the outlet of the channel in the house part is arranged to change from not being in contact with the inlet of the channel in the draining part to partially abut the inlet of the channel in the draining part in a position where the channel in the draining part at the normal draining position of the package inclines at least slightly downwards in the direction towards its outlet which ends outside the package, and where the outlet of the channel in the house part and the inlet of the channel in the draining part further are arranged to abut each other to an increasing extent as the end of the draining part being at a distance from the joint is moved further in the direction downwards. The transition from the outlet of the channel in the house part not being in contact with the inlet of the channel in the draining part to partially abut the inlet of the channel in the draining part, occurs through rotation of the draining part in relation to the house part.

The draining device may be arranged so that the draining part comprises a cylinder formed articulation cylinder and that the house part comprises a cylinder formed articulation bowl, wherein the articulation bowl at least partly encloses the articulation cylinder over more than 180°, whereby the draining part is kept attached articulated to the housing part. It is possible to arrange the draining part and the housing part in other ways.

The draining device may be arranged so that the draining part is arranged to be folded to a position essentially parallel to the wall of the package. Such a position is suitable to use during storage and transport of the package.

The draining device may comprise a recess arranged on the upper side of the housing part in order for the draining part to be able to be moved close to the wall of the package. The recess may have any one of a number of different forms.

The draining part is preferably arranged with the channel being essentially straight, wherein the channel extends essentially perpendicularly from the axis around which it is rotatable. It is however, possible to have other angles between the channel of the draining part and the axis.

The inlet of the draining part may be displaced along the axis in relation to the outlet of the channel in the housing part. This may be preferable when manufacturing the draining device and also gives a larger flexibility for designing the puncturing device.

According to a second aspect of the present invention a package is provided, which comprises a draining device according to the first aspect of the present invention.

The wall of the package may consist of a thin flexible material. The package may also comprise a supporting paper carton which encloses the wall of the thin flexible material.

The package may be arranged to be emptied standing on a surface or alternatively hanging in a handle arranged on the upper side of the package. In both cases the package ends in essentially the same position. It is primarily such a type of packages, which can and are intended to be placed standing on a surface, which are aimed at with the present invention.

By a draining device according to the invention and a package according to the invention comprising the features that a house part of the draining device is arranged to be attached to the outside of the wall of the package and that a draining part of the draining device is arranged with at least one puncturing device which is arranged to puncture the wall of the package so that at least one passage is formed, the advantage is provided that a very cost efficient solution for on the one hand preventing leakage during transport of liquid material located in the package, and on the other hand emptying of the same via a draining device, when needed, by the package not having to be arranged with any lead through in its side wall through which the liquid material may be emptied from the package. By what is stated in the independent claims the advantage is further achieved, that the draining part is emptied when the draining device is closed whereby spillage is avoided and that the draining device not protrudes far out from the package during transport at the same time as a seal may be arranged over the end of the draining part in order to prevent pollutions from entering the draining device and to ensure that the package is unbroken.

SHORT DESCRIPTION OF THE DRAWINGS

The invention will be illustrated in further detail below with reference to the appended drawings, on which:

FIG. 1 shows schematically a front view of a draining device in a completely closed position according to an embodiment of the invention, FIG. 2 shows schematically a cut along the line 1-1 in FIG. 1, FIG. 3 shows schematically a cut along the line 2-2 in FIG. 1, FIG. 4 shows schematically a front view of a draining device in a position where a puncturing device has commenced puncturing of the wall of the package, FIG. 5 shows schematically a cut along the line 1-1 in FIG. 4, FIG. 6 shows schematically a cut along the line 2-2 in FIG. 4, FIG. 7 shows schematically a front view of a draining device in a position where the puncturing device has finished the puncturing of the wall of the package, FIG. 8 shows schematically a cut along the line in FIG. 7, FIG. 9 shows schematically a cut along the line 2-2 in FIG. 7, FIG. 10 shows schematically a view of the movable draining part according to an embodiment of the invention, FIG. 11 shows schematically a front view of an alternative embodiment of a draining device in a position where the puncturing device has commenced puncturing the wall of the package, FIG. 12 shows schematically a cut along the line in FIG. 11, FIG. 13 shows schematically a cut along the line in FIG. 11.

DESCRIPTION OF PREFERRED EMBODIMENTS

Figure 1:
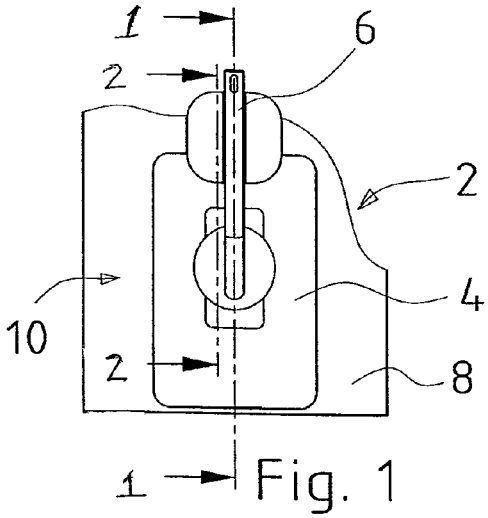

FIG. 1 shows schematically a front view of a draining device 2 in a completely closed position according to an embodiment of the invention, wherein the draining device 2 comprises a house part 4 and a draining part which is movably arranged in relation to the housing part 4 according to what will be described in more detail below. The house part 4 is arranged to be attached to a wall 8, preferably a side wall, of a package 10 for a liquid material, wherein the wall 8 of the package 10 preferably consists of a thin flexible material such as for example plastic foil.

Figure 2:
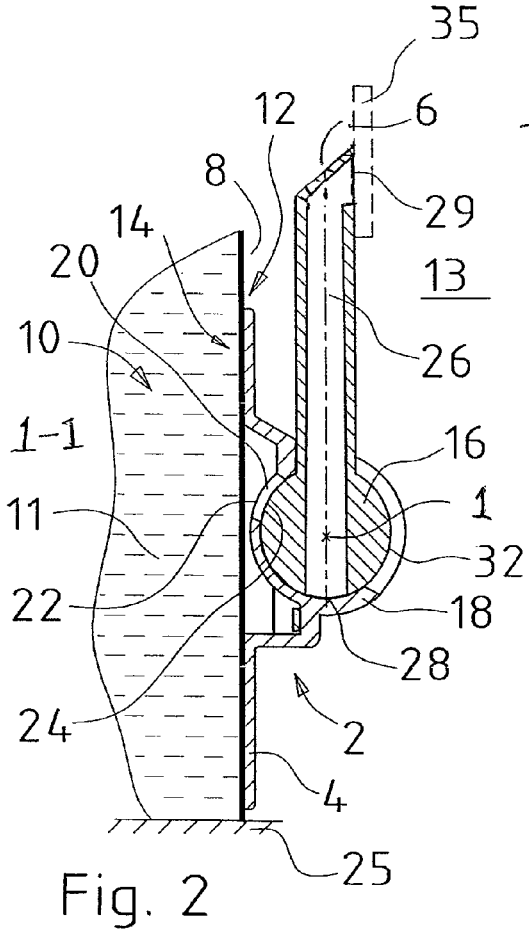

FIG. 2 shows schematically a cut along the line 1-1 in FIG. 1. As is evident from the figure, the draining device 2 comprises a housing part 4 and a relative to the housing part 4 movably arranged draining part 6. The housing part 4 is here shown attached to a wall 8 on a package 10 for a liquid material 11, wherein the wall 8 of the package 10 here is shown to consist of a thin flexible material such as for example plastic foil. The housing part 4 is attached on the outside 12 of the wall 8 of the package 10 as is shown in the figure, as the package 10 in this case does not have to be arranged with any lead through in its side wall through which the liquid material can be emptied from the package. Fixation may for example be achieved through a welding joint, a glue joint, friction joint or in another way.

The draining part 6 is attached articulated to the housing part 4, preferably with a joint of hinge type, i.e., a cylindrical joint which is articulated around an axis A and where the draining part 6 thus may rotate relative to the housing part 4 around the axis A. The above mentioned movement pattern is achieved preferably by the draining part 6 exhibiting a cylinder formed articulation cylinder 16 and by the housing part 4 exhibiting a cylinder formed articulation bowl 18, wherein the articulation bowl 18 encloses the articulation cylinder 16 at least partly over more than 180°, whereby the draining part 6 is kept attached articulated to the housing part 4.

The housing part 4 exhibits a first channel 20 with an inlet 22 which ends towards the inside 14 of the package 10 when draining the contents and an outlet 24 which ends in the section surface between the housing part 4 and the draining part 6. The draining part 6 exhibits a second channel 26 with an inlet 28 which ends in the section surface between the housing part 4 and the draining part 6 and an outlet 29 which ends on the outside 13 of the package 10. By turning the draining part 6 in relation to the housing part 4 the outlet 24 of the channel 20 in the housing part 4 may be moved preferably continuously from not being in contact with to partial or complete abutment with the inlet 28 of the channel 26 in the draining part 6 whereby a flow of liquid material 11 located in the package 10 may be made to flow out through the draining part 6 to the outside 13 of the package 10 whereby the package may be emptied via the draining device 2.

The draining part 6 is preferably arranged elongated in order to create a long lever which facilitates the manoeuvring of the draining device 2.

Figure 3:
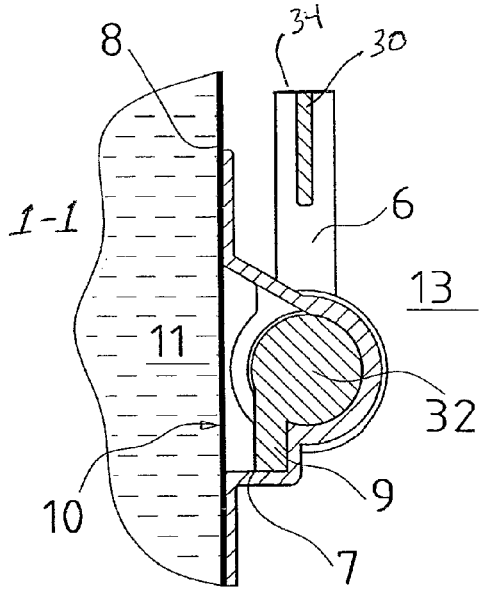

FIG. 3 shows schematically a cut along the line 2-2 in FIG. 1. As is evident from the figure the draining part 6 is preferably arranged with at least one puncturing device 7 in its end 9 being opposite to the outlet 29. The puncturing device 7 is arranged to puncture the wall 8 of the package 10 so that at least one passage is created in the wall 8 of the package 10, through which passage liquid material 11 located in the package 10 may be made to flow out through the draining part 6 to the outside 13 of the package 10 whereby the package may be emptied via the draining device 2.

The draining part 6 may also exhibit at least one grip part 30 in its end 34 being at a distance from to the joint 32, which grip part 30 is arranged to further facilitate the manoeuvring of the draining part 6 around the joint 32 through elongated lever and grip friendly form. This grip part 30 is further preferably arranged to not come in contact with the liquid material 11 for hygienic reasons in those cases the liquid material 11 is intended to be consumed as a beverage or food.

Figure 4:
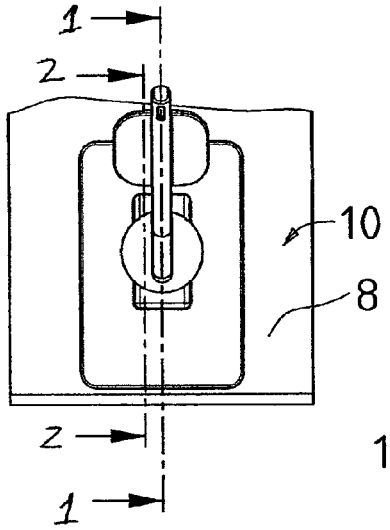

FIG. 4 shows schematically a front view of a draining device 2 in a position where the puncturing device has commenced puncturing of the wall 8 of the package 10.

Figure 5:
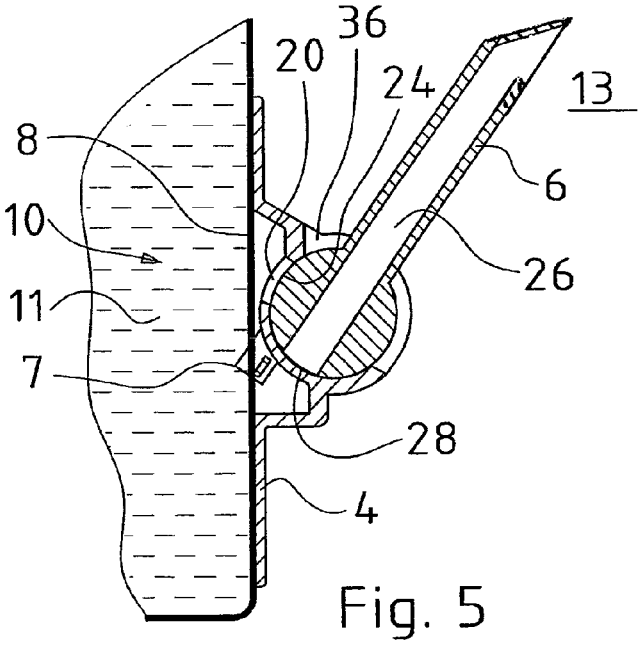

FIG. 5 shows schematically a cut along the line 1-1 in FIG. 4, from which it is evident that the puncturing device 7 has commenced puncturing the wall 8 of the package 10, but that the outlet 24 of the first channel 20 of the housing part 4 which ends in the section surface between the housing part 4 and the draining part 6 not yet has come into contact with the inlet 28 of the second channel 26 of the draining part 6 which ends in the section surface between the housing part 4 and the draining part 6, whereby the outlet 24 of the channel 20 in the housing part 4 not is not in contact with the inlet 28 of the channel 26 in the draining part 6 whereby the liquid material 11 located in the package 10 in this position may not be made to flow out through the draining part 6 to the outside 13 of the package 10. A recess 36 is preferably arranged on the upper side of the housing part 4 in order to allow the draining part 6 to be moved as close to the wall 8 of the package 10 as possible during transport, i.e., the draining part 6 is arranged to be folded to a position essentially parallel to the wall 8 of the package 10. The channel 26 in the draining part 6 exhibits preferably an essentially rectangular cross-section in order for the draining part 6 to protrude as little as possible from the wall 8 of the package 10 during transport at the same time as a sufficient flow through the channel 26 is enabled, where the width of the channel 26 is increased if an increase of the flow is desired. It is also possible to arrange a snap lock (not shown) between the housing part 4 and the draining part 6 in order to retain the draining part 6 against the wall 8 of the package 10 during transport or during storage.

Figure 6:
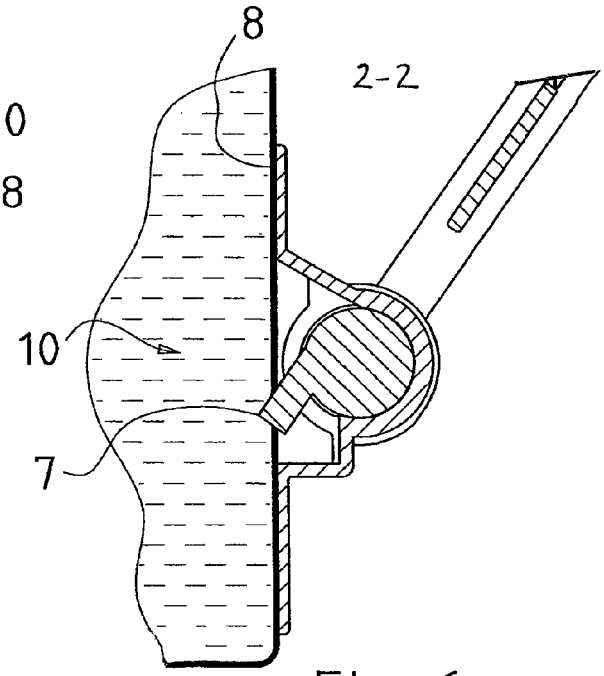

FIG. 6 shows schematically a cut along the line 2-2 in FIG. 4, from which it is evident that the puncturing device 7 has commenced puncturing the wall 8 of the package 10 according to the above.

Figure 7:
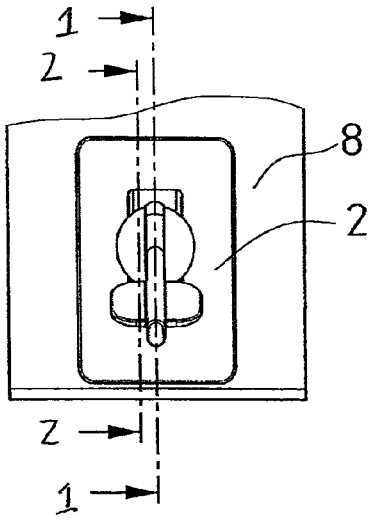

FIG. 7 shows schematically a front view of a draining device 2 in a position where the puncturing device has finished puncturing the wall 8 of the package 10.

Figure 8:
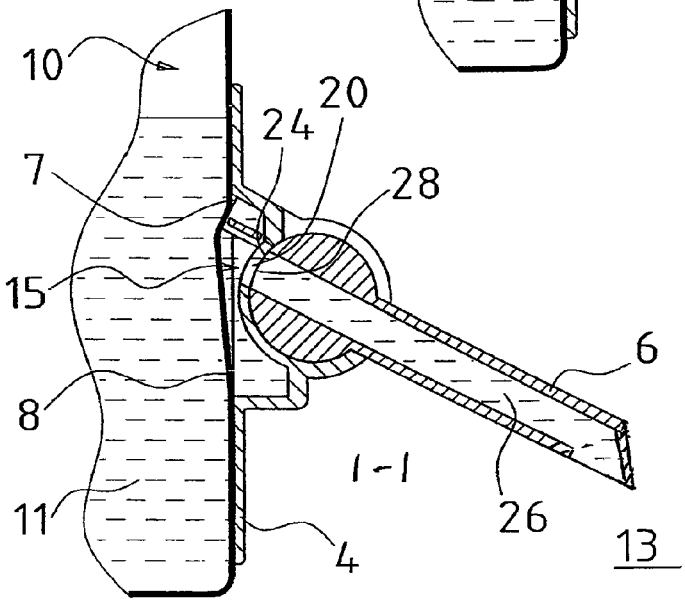

FIG. 8 shows schematically a cut along the line 1-1 in FIG. 7, from which it is evident that the puncturing device 7 has finished puncturing the wall 8 of the package 10, and that the outlet 24 of the first channel 20 of the housing part 4 which ends in the section surface between the housing part 4 and the draining part 6 in this position is in contact with the inlet 28 of the second channel 26 of the draining part 6 which ends in the section surface between the housing part 4 and the draining part 6, whereby the outlet 24 of the channel 20 in the housing part 4 is in contact with the inlet 28 of the channel 26 in the draining part 6 whereby the liquid material 11 located in the package 10 in this position may be made to flow out through the draining part 6 to the outside 13 of the package 10 whereby the package may be emptied via the draining device 2. As is further evident from the figure the puncturing device is preferably arranged to push the wall 8 of the package 10 a small distance into the package 10, whereby the at least one passage 15 in the wall 8 of the package 10 is widened to enable a larger flow through there. This is achieved for example by the puncturing device 7 having a ridge which is essentially wider than its sharp corner, and/or by a transversal means being arranged between two puncturing devices.

Figure 9:
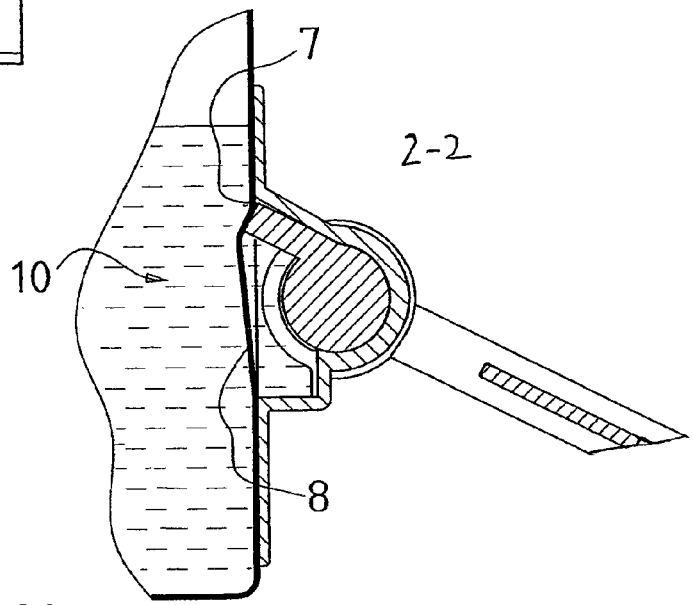

FIG. 9 shows schematically a cut along the line 2-2 in FIG. 7, from which it is evident that the puncturing device 7 has finished puncturing the wall 8 of the package 10 according to the above.

Figure 10:
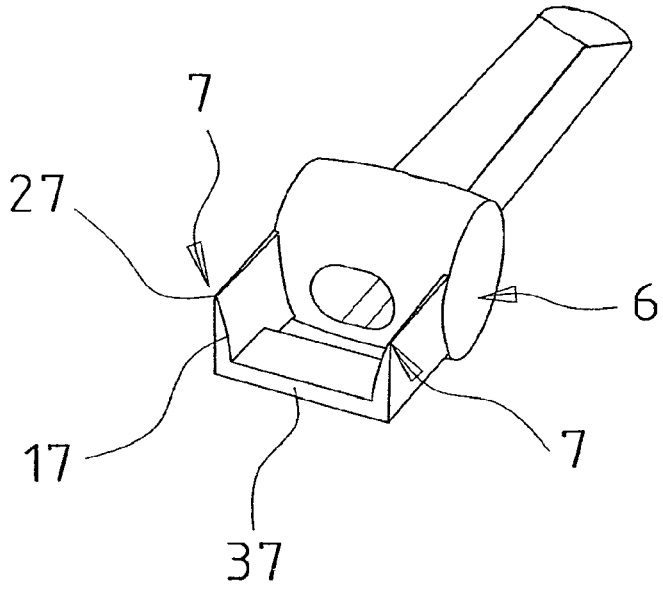

FIG. 10 shows schematically a view of the movable draining part 6 according to an embodiment of the invention. According to this embodiment the puncturing device 7 has a ridge 17 which is essentially wider than its sharp corner 27, and also a transversal means 37 is arranged between two puncturing devices 7.

Figure 11:
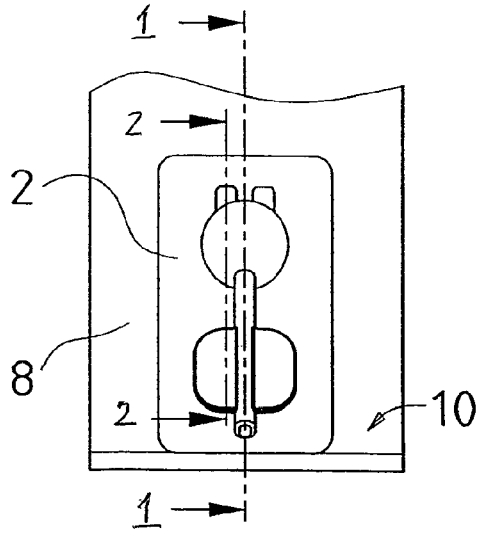

FIG. 11 shows schematically a front view of an alternative embodiment of a draining device 2 in a position where the puncturing device has commenced puncturing of the wall 8 of the package 10.

Figure 12:
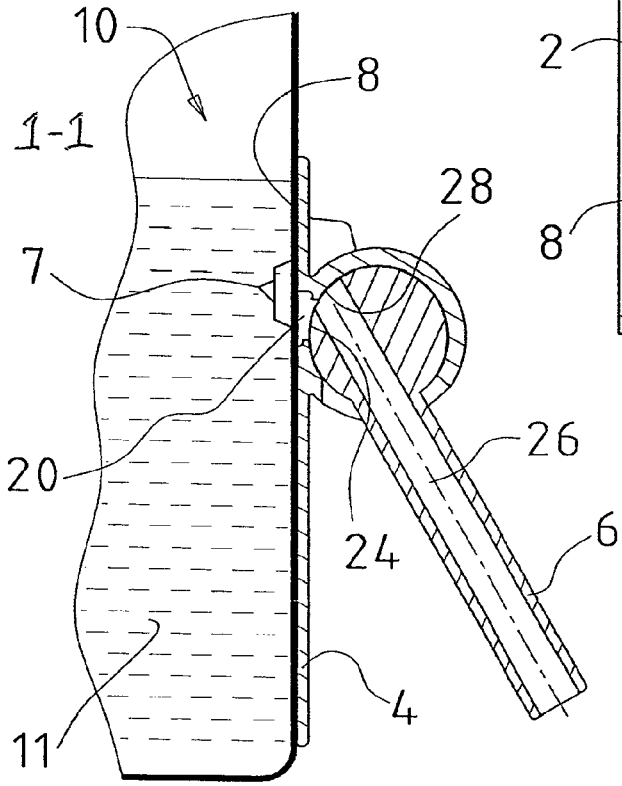

FIG. 12 shows schematically a cut along the line 1-1 in FIG. 11, from which it is evident that the puncturing device 7 has commenced puncturing the wall 8 of the package 10, and that the outlet 24 of the first channel 20 of the housing part 4, which ends in the section surface between the housing 4 and the draining part 6 has come in contact with the inlet 28 of the second channel 26 of the draining part 6, which ends in the section surface between the housing part 4 and the draining part 6, whereby the outlet 24 of the channel 20 in the housing part 4 is in contact with the inlet 28 of the channel 26 in the draining part 6 whereby the liquid material 11 being located in the package 10 in this position may be made to flow out through the draining part 6 to the outside 13 of the package 10. According to this embodiment the draining part 6 is arranged to be folded down to a position essentially parallel to the wall 8 of the package 10, i.e., quite contrary to the embodiment shown in FIG. 2, during transport or during storage.

Figure 13:
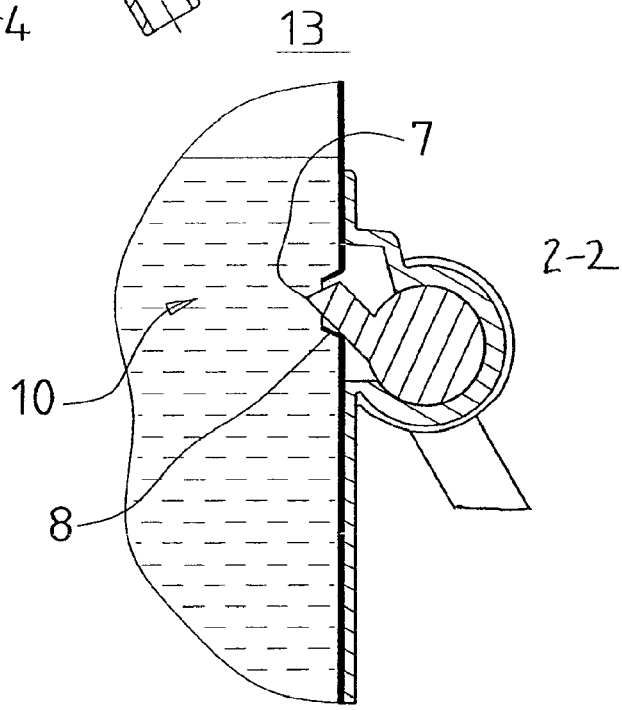

FIG. 13 shows schematically a cut along the line 2-2 in FIG. 11, from which it is evident that the puncturing device 7 has commenced puncturing the wall 8 of the package 10 according to the above.

Figure 14:
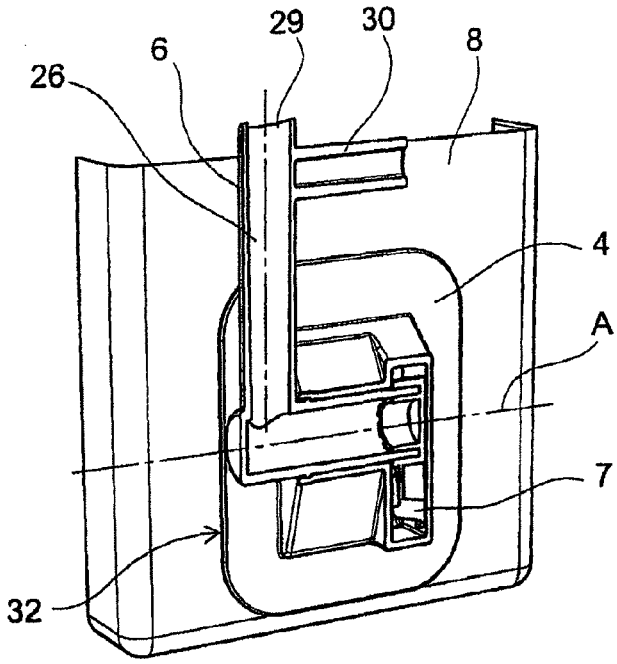
FIG. 14 shows a cross sectional view of a part of a package and a draining device according to an alternative embodiment of the present invention in a closed position for the draining device.

FIG. 14 shows a cross sectional view of a part of a package and a draining device according to an alternative embodiment of the present invention in a closed position for the draining device 2. The embodiment shown in FIG. 14 differs from the earlier embodiments in that the draining part 6 is displaced along the axis A in relation to the first channel 20 (not shown in FIG. 14). As to the rest the function is essentially the same as in the earlier described embodiments. Thus, the draining device may be moved from a closed position to an open position by rotating the draining part 6 around the axis A in relation to the housing part 4. In the shown position for the draining part the draining part 6 is essentially angled straight up parallel to the side wall 8.

Figure 15:
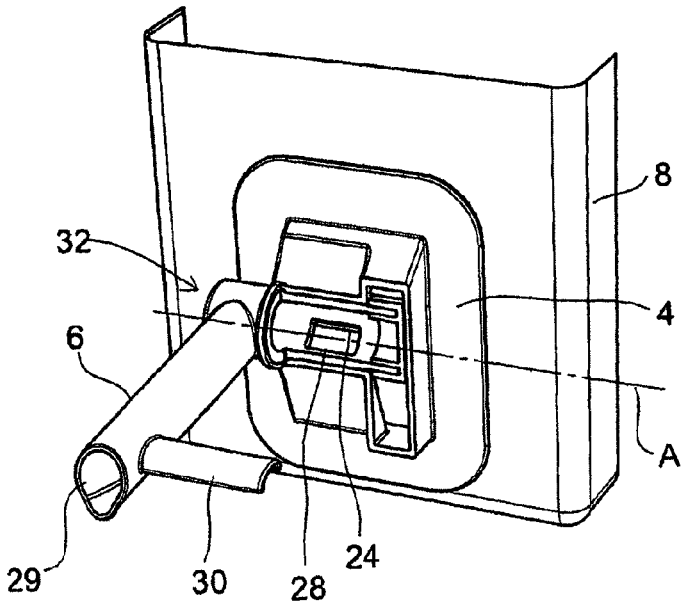
FIG. 15 is a cross sectional view of the package and the draining device in FIG. 14 in the position when the draining device begins to open.

FIG. 15 is a cross sectional view of the package and the draining device in FIG. 14 in the position when the draining device 2 begins to open. In FIG. 15 the draining part 6 has been rotated around the axis A so that the outlet 24 of the channel 20 in the housing 4 has begun to overlap the inlet 28 to the draining part 6. By continued rotation of the draining part 6 it is possible to get the overlap between the outlet 24 of the channel 20 in the housing 4 and the inlet 28 in the draining part 6 to increase.

Figure 16:
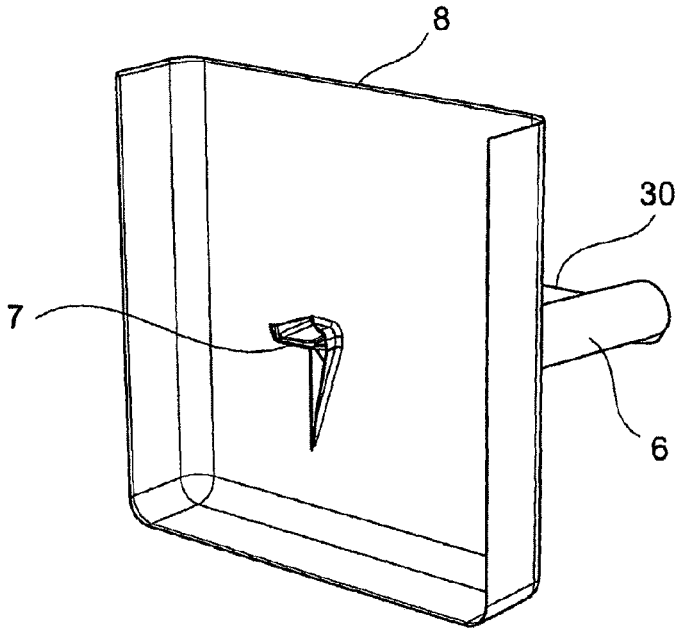
FIG. 16 is a cross sectional view of the package seen from the inside in the position which is shown in FIG. 15.

FIG. 16 is a cross sectional view of the package seen from the inside in the position that is shown in FIG. 15. As is evident by FIG. 16 the puncturing device 7 has penetrated the side wall 8. The puncturing device has such a width perpendicular to the direction of movement, i.e., horizontally in the figure, that the side wall is held away by the puncturing device. Thereby flow of liquid out through the created hole in the side wall 8 is possible.

Figure 17:
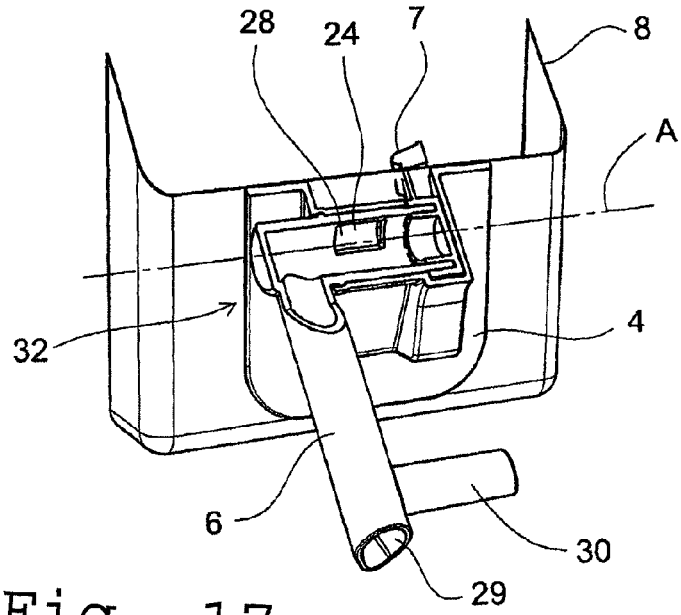
FIG. 17 is a cross sectional view of the package and the draining device in FIG. 14 in the position when the draining device is completely open.

FIG. 17 is a cross sectional view of the package and the draining device in FIG. 14 in the position when the draining device is fully open. In the position shown in FIG. 17 the draining part 6 has been rotated further so that the outlet 24 of the channel 20 in the housing 4 has overlapped the inlet 28 to the draining part 6 maximally.

Again referring to FIG. 2:

The outlet 24 of the channel 20 in the housing part 4 is preferably arranged to change from not being in contact with to partially abut the inlet 28 of the channel 26 in the draining part 6 in a position in the normal position of use of the package 10 where the channel 26 in the draining part 6 inclines at least somewhat downwards towards its outlet 29 which ends outside the package 10 in order to then abut each other to an increasing extent as the end of the draining part 6 being at a distance from the joint 32, is moved further in a direction downwards. That is, if the wall 8 of the package 10 is essentially vertical in the normal position of drainage of the package, i.e., that the package is standing with its essentially horizontal bottom 9 on an essentially horizontal surface 25, the outlet 24 of the channel 20 in the housing part 4 shall be arranged to change from not being in contact with to partially abut the inlet 28 of the channel 26 in the draining part 6 in a position where the channel 26 in the draining part 6 inclines at least somewhat downwards towards its outlet 29 in relation to the horizontal plane. Thereby, it is secured that the draining part 6 is empty when the draining device 2 is closed whereby all spillage is avoided. In the figure a package of this kind is illustrated where the draining part 6 is located in the vertical plane which thus means that the draining device 2 is in a completely closed position.

The outlet 24 of the channel 20 in the housing part 4 is as has been mentioned above preferably arranged to not be in contact with the inlet 28 of the channel 26 in the draining part 6 in a position where the channel 26 in the draining part 6 is horizontal. The same is true preferably the more the end of the draining part 6, being at a distance from the joint 32, is moved further in a direction upwards, whereby the housing part 4, which preferably exhibits a square surface to be attached against the wall 8 of the package 10, may be arranged in the lower edge of the wall 8 of the package 10 and in this way support the wall of the package against a surface at the same time as the wall 8 of the package 10 is punctured as far down as possible which facilitates emptying of the package. The outlet 24 of the channel 20 in the housing part 4 is thus arranged not to be in contact with the inlet 28 of the channel 26 in the draining part 6 in a position where the channel 26 in the draining part 6 inclines at least somewhat upwards in a direction towards its outlet 29 in relation to the horizontal plane at the normal position for draining of the package 10. This is achieved by the outlet 24 of the channel 20 in the housing part 4 being arranged displaced in a direction upwards in relation to the inlet 28 of the channel 26 in the position where the channel in the draining part 6 is in a horizontal position as is evident from the figure. By this construction of the joint 32 the possibility is achieved to fold the draining part 6 up against the wall 8 of the package 10 during transport of the package 10. Hereby the advantage is achieved that the draining device 2 not protrudes any large distance from the wall 8 of the package 10 during transport, which leads to more packages 10 being able to be packed in a transport case of a certain size. Hereby the advantage is also achieved that a seal 35 of for example paper or plastic is arranged to be able to be attached on the side 8 of the package 10 when the draining part 6 is folded up to a position essentially parallel to the wall 8 of the package 10 in such a way that the seal 35 covers the outlet 29 of the draining part 6, whereby a buyer of the package 10 may make sure that the seal is not broken which means that the package 10 has not been opened at the same time as dirt may be prevented from entering the channel 26 in the draining part 6.

The draining device 2, i.e. the emptying device, may for example be arranged far down on the side of the package 10 in the way that is common on "bag-in-box" packages.

The package may be used for liquid material such as liquids or viscose products such as for example marmalade or similar.

The invention claimed is:

1. Draining device for a package for a liquid material, wherein the draining device comprises:

a housing part; and a draining part which is arranged movable in relation to the housing part, wherein the draining part is attached articulated to the housing part around an axis in a joint, wherein the housing part comprises a first channel with an inlet which ends towards the inside of the package during draining of the contents and an outlet which ends in the section surface between the housing part and the draining part, and wherein the draining part comprises a second channel with an inlet which ends in the section surface between the housing part and the draining part and an outlet which ends on the outside of the package, wherein the housing part of the draining device comprises an attachment surface defining a plane along which the housing part is arranged to be attached on the outside of a wall of the package, the plane being vertical in the normal draining position of the package, when the package is standing with its horizontal bottom on a horizontal surface, and the draining part being arranged with at least one puncturing device in its end opposite to the outlet, which puncturing device is arranged to puncture the wall of the package so that at least one passage is formed in the wall of the package through which passage liquid material located in the package may be made to flow out through the draining part to the outside of the package whereby the package may be emptied via the draining device, wherein the housing and the plane defined by the attachment surface define a cavity, wherein the puncturing device is arranged in the cavity when the channel in the draining part is directed upwards from the axis, wherein the axis is horizontal and the outlet of the channel in the housing part is arranged to change from not being in contact with the inlet of the channel in the draining part to abut the inlet of the channel in the draining part in a position where the channel in the draining part in the normal draining position of the package inclines downwards in the direction towards its outlet which ends outside the package, in which position the puncturing device protrudes through the plane defined by the attachment surface, such that the puncturing device widens the passage to enable a larger flow through the passage when the draining part is in the normal draining position, and where the outlet of the channel in the housing part and the inlet of the channel in the draining part further are arranged to abut each other to an increasing extent as the end of the draining part being at a distance from the joint is moved further in a direction downwards, and the outlet of the channel in the housing part is arranged displaced in a direction upwards in relation to the inlet of the channel in the position where the channel in the draining part is in a horizontal position.

2. Draining device according to claim 1, wherein the draining part comprises a cylinder formed articulation cylinder and the housing part exhibits a cylinder formed articulation bowl, wherein the articulation bowl at least partly encloses the articulation cylinder over more than 180°, whereby the draining part is kept attached articulated to the housing part.

3. Draining device according to claim 1, wherein the outlet of the channel in the housing part is arranged not to be in contact with the inlet of the channel in the draining part in a position where the channel in the draining part inclines upwards in a direction towards its outlet in relation to the horizontal plane.

4. Draining device according to claim 1, wherein the draining part is arranged to be folded to a position parallel to the wall of the package.

5. Draining device according to claim 1, wherein a seal is arranged to be attached on the side of the package when the draining part is folded to a position parallel to the wall of the package in such a way that the seal covers the outlet of the draining part.

6. Draining device according to claim 1, wherein the draining part is arranged elongated in order to create a long lever which facilitates maneuvering of the draining device.

7. Draining device according to claim 1, wherein the draining part comprises a grip part arranged to facilitate maneuvering of the draining part.

8. Draining device according to claim 1, wherein the inlet of the draining part is displaced along the axis in relation to the outlet of the channel in the housing part.

9. Package for a liquid material comprising a draining device, wherein the draining device comprises:

a housing part; and a draining part which is arranged movable in relation to the housing part, wherein the draining part is attached articulated to the housing part around an axis in a joint, wherein the housing part comprises a first channel with an inlet which ends towards the inside of the package during draining of the contents and an outlet which ends in the section surface between the housing part and the draining part, and wherein the draining part comprises a second channel with an inlet which ends in the section surface between the housing part and the draining part and an outlet which ends on the outside of the package, wherein the housing part of the draining device comprises an attachment surface defining a plane along which the housing part is arranged to be attached on the outside of a wall of the package, the plane being vertical in the normal draining position of the package, when the package is standing with its horizontal bottom on a horizontal surface, and wherein the draining part is arranged with at least one puncturing device in its end being opposite to the outlet, which puncturing device is arranged to puncture the wall of the package so that at least one passage is formed in the wall of the package through which passage liquid material located in the package may be made to flow out through the draining part to the outside of the package whereby the package may be emptied via the draining device, wherein the housing and the wall of the package define a cavity, wherein the puncturing device is arranged in the cavity when the channel in the draining part is directed upwards from the axis, wherein the axis is horizontal and the outlet of the channel in the housing part is arranged to change from not being in contact with the inlet of the channel in the draining part to abut the inlet in a position where the channel in the draining part inclines downwards in the direction towards its outlet which ends outside the package, in which position the puncturing device protrudes through the wall of the package, such that the puncturing device widens the passage to enable a larger flow through the passage when the draining part is in the downwards direction, and where the outlet of the channel in the housing part and the inlet of the channel in the draining part further are arranged to abut each other to an increasing extent as the end of the draining part being at a distance from the joint is moved further in a direction downwards, and wherein the outlet of the channel in the housing part is arranged displaced in a direction upwards in relation to the inlet of the channel in the position where the channel in the draining part is in a horizontal position.

10. Package according to claim 9, wherein the wall of the package consists of a thin flexible material.

11. Package according to claim 9, which is arranged to be emptied standing on a surface.

12. Draining device for a package for a liquid material, wherein the draining device comprises a housing part and a draining part which is arranged movable in relation to the housing part, wherein the draining part is attached articulated to the housing part around an axis in a joint, wherein the housing part comprises a first channel with an inlet which ends towards the inside of the package during draining of the contents and an outlet which ends in the section surface between the housing part and the draining part, and wherein the draining part comprises a second channel with an inlet which ends in the section surface between the housing part and the draining part and an outlet which ends on the outside of the package, wherein the housing part of the draining device comprises an attachment surface defining a plane along which the housing part is arranged to be attached on the outside of a wall of the package, the plane being vertical in the normal draining position of the package, when the package is standing with its horizontal bottom on a horizontal surface, and the draining part being arranged with at least one puncturing device in its end opposite to the outlet, which puncturing device is arranged to puncture the wall of the package so that at least one passage is formed in the wall of the package through which passage liquid material located in the package may be made to flow out through the draining part to the outside of the package whereby the package may be emptied via the draining device, wherein the housing and the plane defined by the attachment surface define a cavity, wherein the puncturing device is arranged in the cavity when the channel in the draining part is directed upwards from the axis, wherein the axis is horizontal and the outlet of the channel in the housing part is arranged to change from not being in contact with the inlet of the channel in the draining part to partially abut the inlet of the channel in the draining part in a position where the channel in the draining part in the normal draining position of the package inclines downwards in the direction towards its outlet which ends outside the package, in which position the puncturing device protrudes through the plane defined by the attachment surface and where the outlet of the channel in the housing part and the inlet of the channel in the draining part further are arranged to abut each other to an increasing extent as the end of the draining part being at a distance from the joint is moved further in a direction downwards, and the outlet of the channel in the housing part is arranged displaced in a direction upwards in relation to the inlet of the channel in the position where the channel in the draining part is in a horizontal position, and wherein a recess is arranged on the upper side of the housing part in order to allow the draining part to be moved adjacent to the wall of the package.

* * * * *